US005657978A

United States Patent [19]

Meier et al.

[11] Patent Number: 5,657,978

[45] Date of Patent: Aug. 19, 1997

[54] APPARATUS FOR PRODUCING MULTIPLE-PART PRINTED PRODUCTS

[75] Inventors: Jacques Meier, Baretswil; Werner Honegger, Tann-Ruti, both of Switzerland

[73] Assignee: Ferag AG, Switzerland

[21] Appl. No.: 399,562

[22] Filed: Mar. 7, 1995

[30] Foreign Application Priority Data

Mar. 8, 1994 [CH] Switzerland ..... 00685/94

[51] Int. Cl.[6] ..... B65H 39/00

[52] U.S. Cl. ..... 270/52.16; 270/52.2; 270/52.27; 270/52.29; 270/52.3; 271/187; 271/315

[58] Field of Search ..... 270/52.14, 52.16, 270/52.18, 52.2, 52.26, 52.27, 52.29, 52.3, 58.21; 198/644; 271/187, 315

[56] References Cited

U.S. PATENT DOCUMENTS

| | | | |
|---|---|---|---|
| 3,271,023 | 9/1966 | Disbrow et al. . | |
| 3,951,399 | 4/1976 | Reist . | |
| 4,034,974 | 7/1977 | Maopolski . | |
| 4,477,067 | 10/1984 | Wise . | |
| 4,489,930 | 12/1984 | Meier . | |
| 4,601,462 | 7/1986 | Bowman | 270/52.18 X |
| 4,641,825 | 2/1987 | Mowry et al. | 270/52.26 |
| 4,684,117 | 8/1987 | Honegger et al. . | |
| 4,743,005 | 5/1988 | Reist . | |
| 4,811,938 | 3/1989 | Hänsch . | |
| 5,007,629 | 4/1991 | Eberle et al. . | |
| 5,019,716 | 5/1991 | Meier et al. . | |
| 5,052,666 | 10/1991 | Hänsch | 270/52.3 |
| 5,052,667 | 10/1991 | Hänsch . | |
| 5,094,438 | 3/1992 | Reist et al. | 270/52.3 |
| 5,104,108 | 4/1992 | Honegger . | |
| 5,116,033 | 5/1992 | Honegger | 270/52.3 |
| 5,292,110 | 3/1994 | Honegger . | |
| 5,324,014 | 6/1994 | Honegger et al. | 270/52.3 |

FOREIGN PATENT DOCUMENTS

| | | |
|---|---|---|
| 0095603 | 12/1983 | European Pat. Off. . |
| 0346578 | 4/1989 | European Pat. Off. . |
| 0354343 | 7/1989 | European Pat. Off. . |
| 3705257 | 10/1987 | Germany . |

*Primary Examiner*—Hoang Nguyen
*Attorney, Agent, or Firm*—Brinks Hofer Gilson & Lione

[57] ABSTRACT

An apparatus for producing printed products comprising a plurality of part-products, for example newspapers, periodicals and the like, includes a processing drum which is divided into portions and is driven in rotation. The processing drum is provided with saddle-like rests which are distributed uniformly in the circumferential direction. A transporting device transports the products along the saddle-like rests from a product-feeding station which is arranged in the axial drum end region to a product-removal station which is spaced apart in the axial direction from said product-feeding station and is arranged in the opposite drum end region. Provided between the product-feeding station and the product-removal station are at least two product-processing stations. Provided between two product-processing stations and thus also between the product-feeding station and the product-removal station is at least one further product-removal station which can be optionally activated or deactivated. This makes it possible for the drum portions, which are separated from one another by this further product-removal station, to be operated in parallel with respect to one another or in series.

16 Claims, 3 Drawing Sheets

APPARATUS FOR PRODUCING MULTIPLE-PART PRINTED PRODUCTS

BACKGROUND OF INVENTION

The invention generally relates to an apparatus for producing printed products which comprises a plurality of part-products, the apparatus having a processing drum and processing stations positioned along the processing drum.

In such devices the processing drum is driven in rotation about an axis and has saddle-like rests which are distributed uniformly in the circumferential direction and run essentially parallel to the axis. Such devices typically use a transporting mechanism for transporting the products along the saddle-like rests from a product-feeding station, which is arranged in the axial drum end region, to a product-removal station, which is spaced apart in the axial direction from the product-feeding station and is arranged in the opposite drum end region. At least two product-feeding stations are located between the product-feeding station and the product-removal station. More specifically, such product-processing stations may be stations for collecting, inserting, collating, stapling, adhesively bonding individual products, gluing, cutting and/or the like.

Apparatuses of this type are used for producing a vast range of different printed products. This type of apparatus may have a processing drum which is of multi-functional design, where the printed products are joined together to form a finished printed product, for example, by collecting, inserting and/or collating in successive product-processing stations. If required, other specific product-processing stations may be provided (upstream and/or downstream of the individual product-processing stations responsible for collecting, inserting and/or collating) which have special functions. Such special functions may be for example, stapling, adhesively bonding individual products such as cards or product samples, gluing or cutting.

By providing such product-processing stations on a universally usable processing drum, both complex as well as simple printed products of a wide range of different types may be produced.

The disadvantage with this described apparatus, which is suitable for producing complex printed products, is that the production of simple printed products is inefficient. The inefficiency arises because even when simple printed products are being produced, the products pass through all the product-processing stations provided on the processing drum. Some or even most of these product-processing stations may not have to fulfill any function during production of simple printed products and thus they will be switched off.

This results, on the one hand, in insufficient utilization of the product-processing stations. It also results in an unnecessarily prolonged production time, since the products have to pass through all the product-processing stations. Thus, the products must also go through an unnecessarily high number of rotations of the processing drum until they are finally guided away from the processing drum at the product-removal station located in the drum end region.

Therefore, it is an object of the present invention to provide an apparatus where the production of simple printed products and the production of complex printed products can be carried out economically with the same apparatus.

It is a further object of the present invention to provide an arrangement wherein the utilization of the product-processing stations may be increased and/or the production time for simple printed products may be reduced.

SUMMARY OF THE INVENTION

These and other objects are achieved according to the invention by providing, in addition to the standard product-removal station, at least one additional product-removal station in a processing drum arrangement. The further product-removal station is also provided between a product-feeding station which is arranged in the drum end region and the product-removal station which is arranged in the opposite drum end region. The additional or further product-removal station is also provided between two product-processing stations which are spaced apart from one another in the axial direction of the drum. The at least one further product-removal station can be optionally activated and deactivated.

With this arrangement according to the invention, the processing drum with the product-processing stations provided thereon can be used in the conventional manner for series operation for producing complex printed products. In this case the first part-products which are to be joined together with other part-products are fed to the processing drum via the product-feeding station which is arranged in the axial drum end region. Then, upon passing through all the product-processing stations provided on the processing drum, the product parts are joined together or processed with further part-products. Finally, the product is removed, as the finished product, from the product-removal station which is arranged in the opposite drum end region.

For the production of simple printed products according to the invention, the further product-removal station is provided and arranged downstream of the product-processing stations which are required for producing the product and upstream of the product-processing stations which are not required for producing the product (as seen in the transporting direction). As a result, an unnecessary and time-consuming passage through the product-processing stations which are not required is avoided. In this manner, the time for producing simple printed products in an apparatus which is also suitable for producing complex printed products is considerably reduced.

In this arrangement, the further product-removal station can be activated or deactivated. As a result, the further product-removal station can be put into operation for producing simple printed products and can be put out of operation for producing complex printed products.

In a particularly preferred embodiment of the invention, a further product-feeding station is provided downstream of the further product-removal station and upstream of at least one product-processing station, as seen in the transporting direction. This arrangement permits the apparatus to be operated such that the production of products is carried out in parallel with the further product-removal station in the activated state for the production of simple printed products. This makes it possible to simultaneously produce one product with the product-processing stations which are arranged between the product-feeding station which is provided in the drum end region and the further product-removal station and another product with the product-processing stations which are arranged between the further product-feeding station and the product-removal station which is provided in the drum end region. In this manner, on the one hand, the time for producing a simple printed product can be considerably reduced. On the other hand, the utilization of the product-processing stations which are provided on the processing drum may also be considerably improved since the parallel operation of two or more drum portions for the simultaneous production of a plurality of printed products avoids the situation where specific drum portions having a plurality of product-processing stations do not contribute in any way to the production of the product.

DETAILED DESCRIPTION OF THE PRESENTLY PREFERRED EMBODIMENTS

Figure 1:
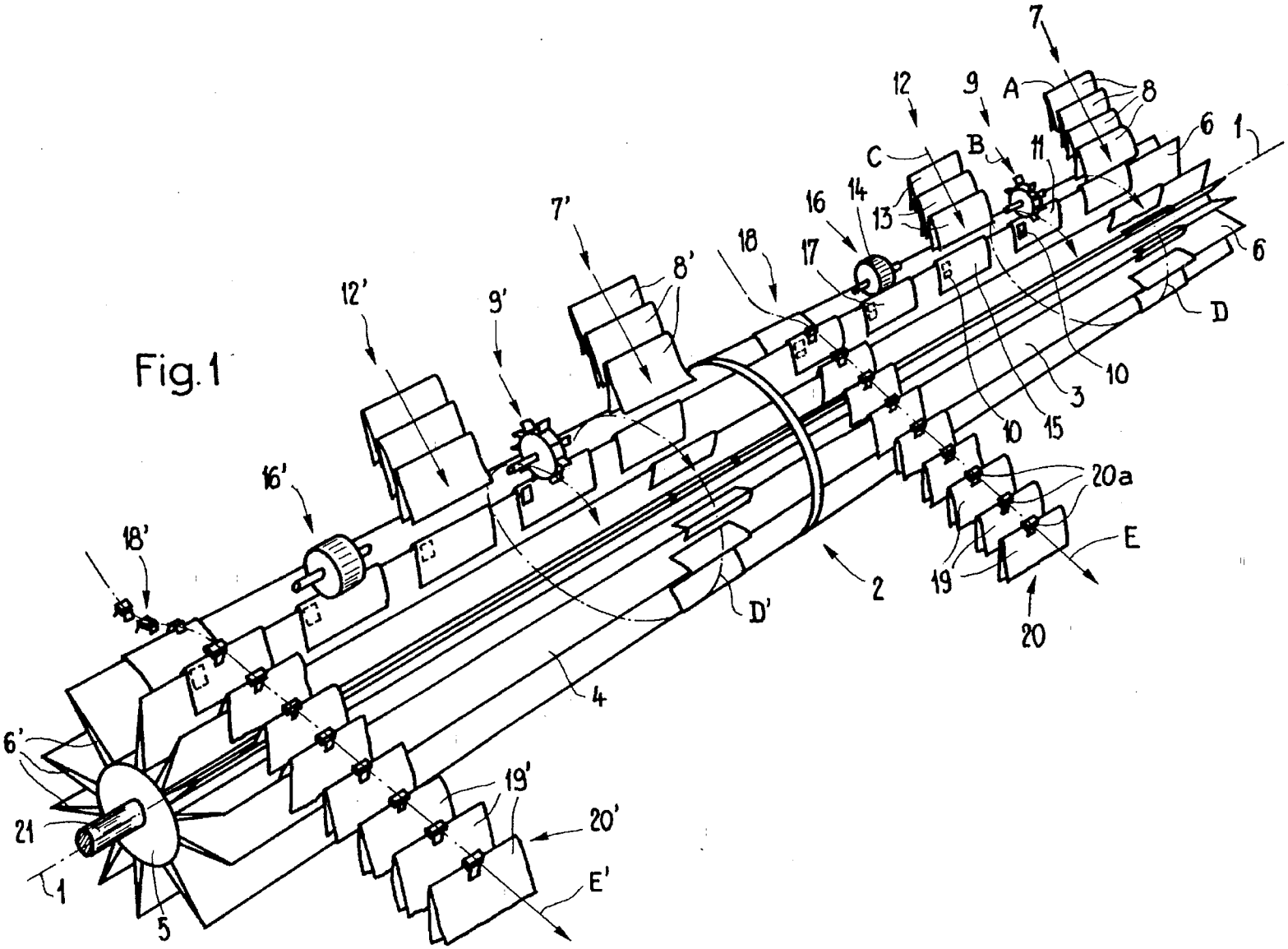
FIG. 1 shows an apparatus according to a preferred embodiment of the invention operating in parallel.

The apparatus represented in FIG. 1 comprises a processing drum 2 which is driven in rotation about a horizontal axis 1 and comprises a first portion 3 and of a second portion 4.

In this arrangement, the processing drum 2 includes a cylindrical core portion 5. On the outer surface of the processing drum 2 there are arranged saddle-like rests 6 which are distributed uniformly in the circumferential direction and run parallel to the axis 1. Provided in the end region of the first portion 3 of the processing drum 2 which is directed away from the second portion 4 is a product-feeding station 7. In the product-feeding station 7 folded individual products 8 are fed to the processing drum 2 in the direction of the arrow A and are deposited one after the other on one of the rests 6 of the rotating processing drum 2.

Adjoining the product-feeding station 7 in the direction of the drum axis 1, offset with respect to the same, is a card adhesive-bonding station 9. Cards 10 are fed in the direction of the arrow B to the adhesive-bonding station 9 wherein the cards 10 are adhesively bonded onto the product 11.

Provided offset in the axial direction with respect to the card adhesive-bonding station 9 is a collecting station 12. In the collecting station 12 folded products 13 are deposited in a straddling manner (in the direction of the arrow C) on the products 15 already provided with cards 10, adhesively bonded thereon.

The collecting station 12 is adjoined by a stapling station 16 which includes a rotary stapler 14. By means of the rotary stapler 14 the part-products which form the finished printed product 17 are stapled to one another on their common fold.

The rotary stapler 14 is adjoined by a product-removal station 18. In this product-removal station 18 each of the finished products 19 is seized by an automatically actuable clamp 20*a* of a removal conveyor 20 and is raised from the respective rest 6. The removal conveyor 20 conveys the products 19 away from the processing drum 2 tangentially in the direction of the arrow E.

All the stations which have been described up until now are arranged in the region of the first portion 3 of the processing drum 2.

That region of the first portion 3 of the processing drum 2 which is provided with the product-removal station 18 is adjoined, in an axially aligned manner, by the portion 4 of the processing drum 2. The saddle-like rests 6, 6' of the two portions 3, 4 of the processing drum 2 are circumferentially aligned with one another (this not being absolutely necessary in the mode of operation according to FIG. 1). This arrangement results in a flush transition between the rests 6, 6' of the two portions 3, 4 of the processing drum 2.

The portion 4 of the processing drum 2 is, similarly to portion 3, provided with corresponding stations 7', 9', 12', 16' and 18'.

If the apparatus according to FIG. 1 is set in operation, the two portions 3, 4, driven preferably via a common drive shaft 21, of the processing drum 2 begin to rotate synchronously. The two product-feeding stations 7, 7' then begin to operate simultaneously. As a result individual products 8, 8' are fed, for further processing, to the two portions 3, 4 of the processing drum 2.

The rests 6, 6' are provided in a known manner with transporting means (not shown) by means of which the products deposited on the rests 6, 6' can be conveyed along said rests 6, 6' in the direction of the drum axis 1. Due to the combination of the conveying movement from the transporting means, with the rotation of the processing drum 2, the products deposited on the rests 6, 6' move in an essentially helical path (indicated by the arrows D, D') about the drum axis 1. The products are displaced, during one revolution of the drum, in the drum-axis direction in each case by the distance provided between two adjacent stations. The result is that one processing operation can be carried out on each product located in the apparatus per revolution of the processing drum 2. The products are not pushed forward in the region of the feeding stations and processing stations 9, 12, 16, 7', 9', 12', 16'.

Consequently, these products pass, on the movement path mentioned, through all the stations 9, 12, 16 and 9', 12', 16' provided on the respective portion 3, 4 of the processing drum 2. Then, at the respective product-removal stations 18, 18', the products are conveyed away, as finished product 19, 19', by the removal conveyor 20, 20' from the respective portion 3, 4 of the processing drum 2 in the direction of the arrows E, E'.

Accordingly, with the apparatus described, two identical products can be simultaneously produced one on each portion 3, 4 of the processing drum 2. Thus, all the stations provided on the processing drum 2 are constantly in operation and being utilized. In this manner, all the stations are utilized to the optimum extent and the production time necessary per product is reduced to a minimum.

This parallel operation, which is favorable from a commercial viewpoint, of an apparatus according to FIG. 1 is made possible according to the invention by providing the further product-removal station 18 between the two product-processing stations 16 and 9'. Advantageously, a further product-feeding station 7' is arranged downstream of the product-removal station 18 and upstream of the product-processing station 9'.

For parallel operation, it is not necessary to drive the two portions 3, 4 of the processing drum 2 synchronously, in particular via a common shaft 21. The two portions 3, 4 may also be driven by different drive elements. Different rotational speeds of the two portions 3, 4 are also possible.

It will be recognized that the drum 2 may also be subdivided into three or more portions, by providing corresponding further product-removal stations and product-feeding stations at the respective end regions of the individual portions.

The individual product-processing stations 7, 9, 12, 16, 7', 9', 12', 16' provided on the processing drum 2 can be optionally activated or deactivated in order to be able to produce different products.

Furthermore, it is not necessary to operate the stations of the first portion 3 and of the second portion 4 of the processing drum 2 in the same manner in order to produce identical products. Rather, it may, in specific cases, be desirable to provide the individual drum portions 3, 4 with different stations and/or to activate different stations on the individual portions 3, 4. In this manner, it is possible to simultaneously produce different products on each of the two portions 3, 4. This type of process is of interest, in particular, for the regionalization of daily or weekly newspapers. In such regionalized arrangements specific parts of the product to be produced are the same for all regions and other parts, depending on the specific region of the product produced, are different. Such printed products which are regionally different, but identical with respect to specific parts can be produced particularly advantageously, by an apparatus operated in parallel operation according to FIG. 1.

The apparatus represented in FIG. 2 corresponds to an apparatus of FIG. 1 except that the apparatus is operated in series as described below. For purposes of clarity, however, not all the reference numerals are drawn in the representation of FIG. 2.

Figure 2:
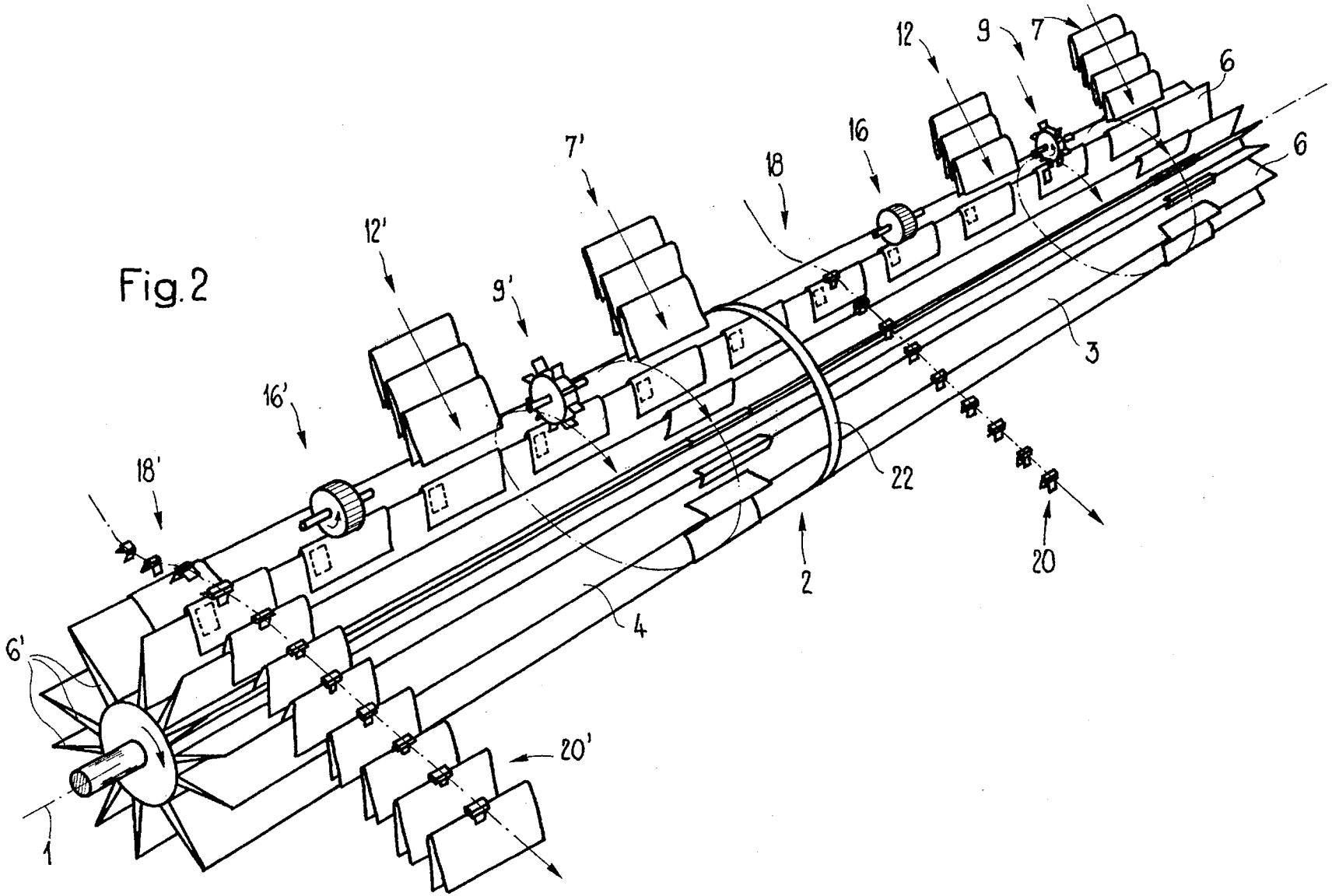
FIG. 2 shows an apparatus according to a preferred embodiment of the invention operating in series.

In series operation, shown in FIG. 2, it is essential that the two portions 3, 4 of the processing drum 2 are either fixedly connected to one another by mechanical means via the gap 22, which is formed between them on the end sides, or if such a connection is not provided are activated by two synchronously running drives. In this arrangement, the two portions 3, 4 must be located in such an angular position with respect to one another that the saddle-like rests 6, 6' of the two portions 3, 4 are in alignment with one another.

Furthermore, the transporting means (not shown) of the two portions 3, 4 (which push or pull the products in the direction of the axis 1 via the rests 6, 6') have to be coupled to one another in such a manner that the products can be conveyed from a rest 6 of the portion 3, via the gap 22, to a rest 6' of the portion 4. This arrangement make it possible for the products which have already been processed in the region of the portion 3 to be subsequently further processed in the region of the portion 4.

For series operation represented in FIG. 2, it is important that the further product-removal station 18, and thus also the removal conveyor 20, is at rest. Thus, during series operation, the products are not conveyed away in the end region of the portion 3, but only in the end region of the portion 4, by the removal conveyor 20' at the product-removal station 18'.

The station 7' which in parallel operation (FIG. 1) serves as the product-feeding station to the second portion 4 is, in series operation (FIG. 2), operated just as in the case of parallel operation. In series operation, however, the station 7' acts as a collecting station which positions additional part-products on products which have already been processed in the region of the portion 3.

Since, in series operation, a greater number (in the example according to FIGS. 1 and 2, twice the number) of product-processing stations is available per product produced, considerably more complex products can be produced in series operation than in parallel operation. In series operation, all, or only some of, the product-processing stations provided on the various portions of the processing drum can be used one after the other for processing and producing an individual product. In this arrangement, the individual product-processing stations may be engaged or disengaged as required.

The apparatus according to the invention permits both simple and complex printed products to be produced rapidly and cost-effectively. Moreover, existing systems comprising, for example, only one processing-drum portion can be readily expanded to a system comprising a plurality of processing-drum portions. As a result, the variability and efficiency of the entire system can be increased. This avoids the need to scrap existing apparatuses, and to instead utilize existing apparatuses further in conjunction with the system expansion. This modularity obtained by dividing the processing drum into a plurality of portions provides the user with a considerably higher degree of flexibility in planning and possible subsequent expansion of the apparatuses required for producing printed products.

Figure 3:
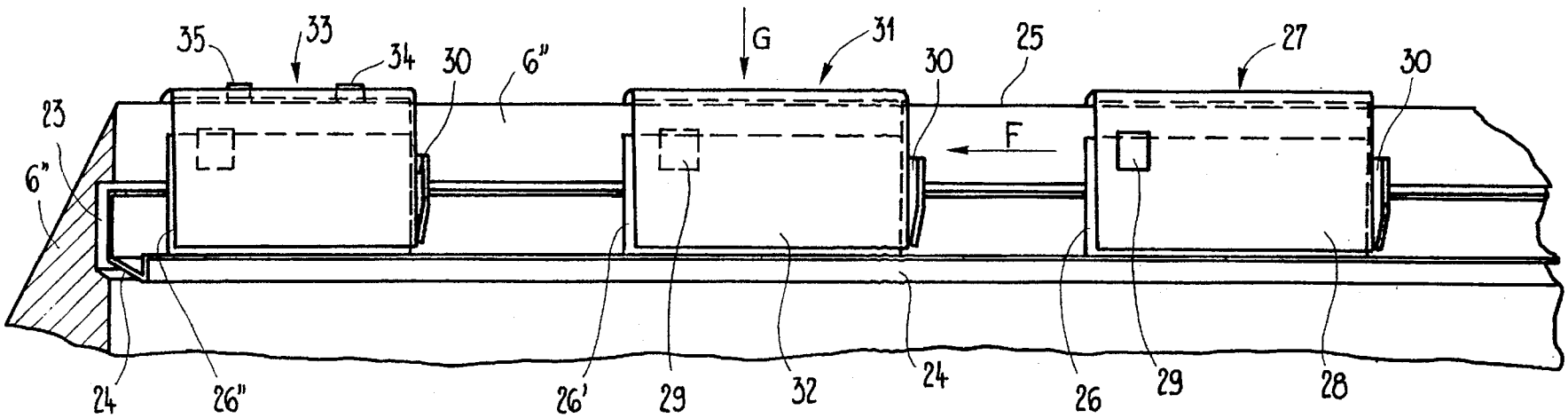
FIG. 3 shows an embodiment of a saddle-like rest provided on a processing drum.

FIG. 3 shows a saddle-like rest 6" which may be used in an apparatus according to FIGS. 1 and 2.

The rest 6" is provided on one side with a profile rail 24 which is fastened on an angle element 23 and extends parallel to the saddle 25 of the rest 6". The profile rail forms a receiving region for products 26, 26', 26" which are to be inserted.

The product represented at 27 comprises a single-part or multiple-part individual product 26, which bears on the profile rail 24, to the side of the rest 6", and is optionally folded. The product 27 further comprises a folded product 28 which is deposited on the rest 6", over said individual product 26, and has a card 29 adhesively bonded on it. The intermediate product 26, 28, 29 made up in this manner is transported, by a linearly movable pusher 30, in the direction of the arrow F.

At 31, a further product 32 is deposited over the product 28 from a collecting station (not shown) in the direction of the arrow G. At 31, the product 28 which cannot be seen and is represented in broken lines is thus located beneath the product 32.

The product which is joined together in this manner is then transported further in the direction of the arrow F until, at 33, two staples 34, 35 are provided on the common fold of the products 28, 32 by a stapling station (not shown).

The representation in FIG. 3 is intended to clarify that an apparatus according to the invention may also be used to produce end products in the case of which the inner part-products are not only collected, as is shown in FIG. 1, but are also, at least in part, inserted or collated.

Figure 4:
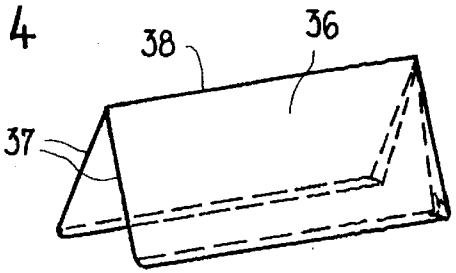
FIG. 4 shows a part-product which can be fed to an apparatus according to the invention.

FIG. 4 illustrates an individual product which can be processed by an apparatus according to the invention. The individual product is provided, as a 2-fold product 36, with an end-side fold 37 and a fold 38. When individual products 36 are collected on a rest 6, 6', 6", the fold 38 comes to lie on the saddle 25 according to FIG. 3. In addition to part-products which have been folded once the apparatus of the present invention may also be used to process so-called tabloids or other 2-fold products, i.e. these products may be collected and provided with cards and the like.

The foregoing description of the preferred embodiments of the present invention has been presented for purposes of illustration and description. The preferred embodiments are not intended to be exhaustive, or to limit the invention to the precise forms disclosed, and obviously many modifications and variations are possible in light of the above teachings. It is intended that the scope of the invention be defined by the following claims, including all equivalents.

We claim:

1. Apparatus for producing printed products comprising a plurality of part-products comprising:

a processing drum which is driven in rotation about an axis and includes at least two axially aligned individual portions with rests on which the part-products are positioned, the rests of the individual portions being in alignment with one another;

a product-feeding station which is arranged on an axial drum end region;

a product-removal station which is spaced apart in the axial direction from said product-feeding station and is arranged on an opposite drum end region;

transporting means for transporting the product-parts from the product-feeding station to the product-removal station, the transporting means of the individual portions being coupled to one another;

at least two product-processing stations disposed between the product-feeding station and the product-removal station; and at least one further product-removal station which can be selectively activated and deactivated, the at least one further product-removal station disposed between the two product-processing stations.

2. Apparatus according to claim 1, further comprising a further product-feeding station disposed downstream of the further product-removal station and upstream of at least one product-processing station, as seen in the transporting direction.

3. Apparatus according to claim 1, wherein the portions of the processing drum are activated by a single drive element.

4. Apparatus according to claim 3, wherein the single drive element comprises a drive shaft.

5. Apparatus according to claim 1, wherein the portions of the processing drum are activated by different drive elements.

6. Apparatus according to claim 5 wherein the different drive elements are driven synchronously.

7. Apparatus according to claim 1, wherein at least one of the individual product-processing stations can be selectively activated and deactivated in accordance with the type of products to be processed.

8. Apparatus according to claim 2, wherein the further product-feeding station is arranged directly downstream of the further product-removal station.

9. Apparatus according to claim 2, wherein mutually corresponding product-processing stations are arranged between the drum-end-region product-feeding station and the further product-removal station and between the further product-feeding station and the drum-end-region product-removal station.

10. Apparatus according to claim 1, wherein an insertion region is formed in each case between two rests, which are adjacent in the circumferential direction, of the processing drum.

11. Apparatus according to claim 10, wherein the rests of the processing drum are each provided on one side with a securing device which runs in the axial direction.

12. Apparatus according to claim 11, wherein the securing device comprises a profile rail for receiving products which are to be inserted.

13. A process for producing printed products comprising a plurality of part-products comprising the steps of:

depositing part-products on rests of at least two axially aligned individual portions of a processing drum which is driven in rotation about an axis, the rests of the individual portions being in alignment with one another;

feeding the product to the processing drum in a product-feeding station which is arranged on an axial drum end region;

removing the product from the processing drum in a product-removal station which is spaced apart in the axial direction from said product-feeding station and is arranged on an opposite drum end region;

transporting the product-parts from the product-feeding station to the product-removal station with transporting means, the transporting means of the individual portions being coupled to one another;

processing the product in at least two product-processing stations disposed between the product-feeding station and the product-removal station;

providing at least one further product-removal station between the two product processing stations to remove the products from the processing drum; and selectively activating and deactivating the at least one further product-removal station.

14. The process according to claim 13, wherein the part-products are first positioned on a securing device, then to the side of the rests, and subsequently further, folded part-products are positioned in a straddling manner on the rests such that they cover over said part-products.

15. Apparatus for producing printed products comprising a plurality of part-products using a processing drum which is driven in rotation about its axis and includes at least two axially aligned individual portions with rests on which the part-products are positioned, wherein the rests of the individual portions are in alignment with one another and the product parts are moved on the rests from one end of the individual portion of the processing drum to the other end of the individual portion of the processing drum by transporting means, the transporting means of the individual portions being coupled to one another, the apparatus comprising:

a product-feeding station arranged on an axial drum end region;

a product-removal station spaced apart in the axial direction from said product-feeding station and arranged on an opposite drum end region;

at least two product-processing stations disposed between the product-feeding station and the product-removal station; and at least one further product-removal station which can be selectively activated and deactivated, the at least one further product-removal station disposed between the two product-processing stations.

16. Apparatus according to claim 15, further comprising a further product-feeding station disposed downstream of the further product-removal station and upstream of at least one product-processing station, as seen in the transporting direction.

* * * * *